US010058723B2

(12) United States Patent
Nickel et al.

(10) Patent No.: US 10,058,723 B2
(45) Date of Patent: Aug. 28, 2018

(54) FOLDABLE PARALLEL BAR APPARATUS

(71) Applicants: Eric A. Nickel, Brooklyn Park, MN (US); Andrew H. Hansen, Apple Valley, MN (US); Adam Stephen Breyette, Lakeville, MN (US); Binghan Chen, Xiamen (CN); Kristin Huber, Mendota Heights, MN (US); Ross Klabon, Wisconsin Rapids, WI (US); Thomas C. LaSee, Minneapolis, MN (US); William Gunther Voss, Shakopee, MN (US); Steven M. Morin, Bloomington, MN (US)

(72) Inventors: Eric A. Nickel, Brooklyn Park, MN (US); Andrew H. Hansen, Apple Valley, MN (US); Adam Stephen Breyette, Lakeville, MN (US); Binghan Chen, Xiamen (CN); Kristin Huber, Mendota Heights, MN (US); Ross Klabon, Wisconsin Rapids, WI (US); Thomas C. LaSee, Minneapolis, MN (US); William Gunther Voss, Shakopee, MN (US); Steven M. Morin, Bloomington, MN (US)

(73) Assignee: The United States of America as represented by the Department of Veterans Affairs, Washington, DC (US)

( * ) Notice: Subject to any disclaimer, the term of this patent is extended or adjusted under 35 U.S.C. 154(b) by 416 days.

(21) Appl. No.: 14/022,815

(22) Filed: Sep. 10, 2013

(65) Prior Publication Data

US 2014/0087920 A1 Mar. 27, 2014

Related U.S. Application Data

(60) Provisional application No. 61/851,743, filed on Mar. 13, 2013, provisional application No. 61/744,460, filed on Sep. 27, 2012.

(51) Int. Cl.
*A63B 3/00* (2006.01)
*A63B 23/04* (2006.01)
(Continued)

(52) U.S. Cl.
CPC ..... *A63B 3/00* (2013.01); *A63B 23/0464* (2013.01); *A63B 2022/0094* (2013.01);
(Continued)

(58) Field of Classification Search
CPC .... A63B 3/00; A63B 4/00; A63B 5/00; A63B 5/02; A63B 5/04; A63B 5/60; A63B 5/08;
(Continued)

(56) References Cited

U.S. PATENT DOCUMENTS 1,639,110 A * 8/1927 Rautenberg ..... A47D 7/002 5/100
2,720,292 A * 10/1955 Roberts ..... E05F 17/00 49/343
(Continued)

OTHER PUBLICATIONS

"Wikipedia: The Free Encyclopedia." Internet: http://en.wikipedia.org/wiki/Gait_training, (3 pgs.) (Accessed Jun. 17, 2014).
(Continued)

*Primary Examiner* — Garrett Atkinson
(74) *Attorney, Agent, or Firm* — Ballard Spahr LLP

(57) ABSTRACT

A foldable parallel bar apparatus includes generally U-shaped first and second end frames and a set of handrails connected to and extending between the first and second end frames, wherein the handrails are foldable so as to move the first and second end frames closer to one another thereby compacting the apparatus. When multiple modules of the end frames are connected, they provide an uninterrupted path between the handrails. An alternative embodiment
(Continued)

provides base platforms that are foldable relative to each other and handrails that are vertically and horizontally adjustable.

26 Claims, 6 Drawing Sheets

(51) Int. Cl.
*A63B 71/02* (2006.01)
*A63B 22/00* (2006.01)

(52) U.S. Cl.
CPC ..... *A63B 2071/025* (2013.01); *A63B 2210/50* (2013.01); *A63B 2225/09* (2013.01)

(58) Field of Classification Search
CPC .... A63B 5/10; A63B 5/11; A63B 5/12; A63B 5/16; A63B 23/0464; A63B 2022/0094
USPC ..... 482/23, 26–32, 35–36, 38–43, 142
See application file for complete search history.

(56) References Cited

U.S. PATENT DOCUMENTS 3,929,330 A * 12/1975 Cerasoli ..... A63B 3/00 482/42
4,126,307 A * 11/1978 Stevenson ..... A63B 1/00 248/363
4,382,612 A * 5/1983 Larkin ..... A63B 55/60 280/646
4,629,183 A * 12/1986 Perrine ..... A63B 21/0724 482/105
4,819,938 A * 4/1989 Hill ..... A63B 57/0037 294/19.2
5,605,524 A * 2/1997 Husted ..... A63B 21/00072 482/112
5,924,960 A * 7/1999 Cohen ..... A63B 21/00047 434/255
6,162,061 A * 12/2000 Taylor ..... A63B 5/11 434/253
6,168,548 B1 * 1/2001 Fleming ..... A63B 3/00 482/23
6,238,320 B1 * 5/2001 Flanagan ..... A63B 3/00 482/130
6,248,048 B1 * 6/2001 Zuckerman ..... A63B 21/00047 482/141
6,743,152 B2 * 6/2004 Weiss ..... A63B 1/00 482/34
7,713,175 B2 * 5/2010 Monaghan ..... A47D 13/04 482/35
2002/0035016 A1 * 3/2002 Weiss ..... A63B 1/00 482/34
2003/0199372 A1 * 10/2003 Robinson ..... A63B 21/068 482/140
2004/0009845 A1 1/2004 Johnson
2005/0130806 A1 * 6/2005 Lopez ..... A63B 21/00047 482/38
2010/0331155 A1 * 12/2010 Gorsuch ..... A63B 3/00 482/142
2011/0021321 A1 * 1/2011 Legg ..... A63B 5/11 482/29
2011/0039667 A1 * 2/2011 Teng ..... A63B 23/03541 482/142
2012/0277075 A1 * 11/2012 Ho ..... A63B 17/00 482/141

OTHER PUBLICATIONS

Dr. G. Cooper, MD, "Spine-Health." Internet: http://www.spine-health.com/conditions/leg-pain/what-foot-drop, (1 pg.) (Accessed Jun. 17, 2014).
"Patterson Medical." Internet: http://www.pattersonmedical.com/app.aspx?cmd=get_product&id=44390, [Jan. 27, 2012].
"Tri W-G." Internet: http://triwg.com/index.php/parallel_bars/, (2 pgs.) (Accessed Jun. 17, 2014).
"Advantage Medical." Internet: http://www.advantagemedical.com/search/ . . . , (1 pg.) (Accessed Jun. 17, 2014).
"3B Scientific." Internet: http://products.a3bs.com/search . . . , (3 pgs.) (Accessed Jun. 17, 2014).
"Beam Deflection Formulae." Internet: http://www.advancepipeliner.com/Resources/Others/Beams/Beam_Deflection_Formulae.pdf, (2 pgs.) (Accessed Jun. 17, 2014).
"Rope Inc." Internet: http://www.ropeinc.com/marine-yacht-chain-anchors-snubbers.html, (2 pgs.) (Accessed Jun. 17, 2014).
"The Engineering Toolbox." Internet: http://www.engineeringtoolbox.com/material-properties-t_24.html, (19 pgs.) (Accessed Jun. 17, 2014).
"Salzgitter Mannesmann Stainless Tubes." Internet: www.smst-tubes.com/en/products-services/products/, (2 pgs.) (Accessed Jun. 17, 2014).
PCT International Search Report and the Written Opinion dated Jul. 1, 2014, in International Appl. No. PCT/US2014/023158, filed Mar. 11, 2014 (8 pp).

* cited by examiner

FIG. 5
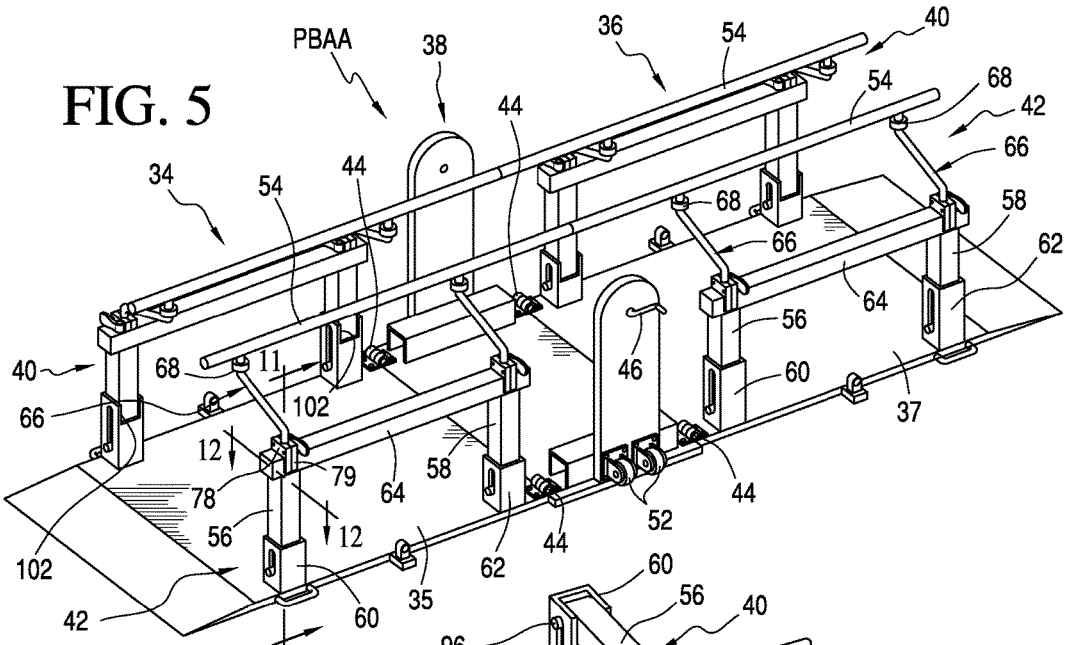
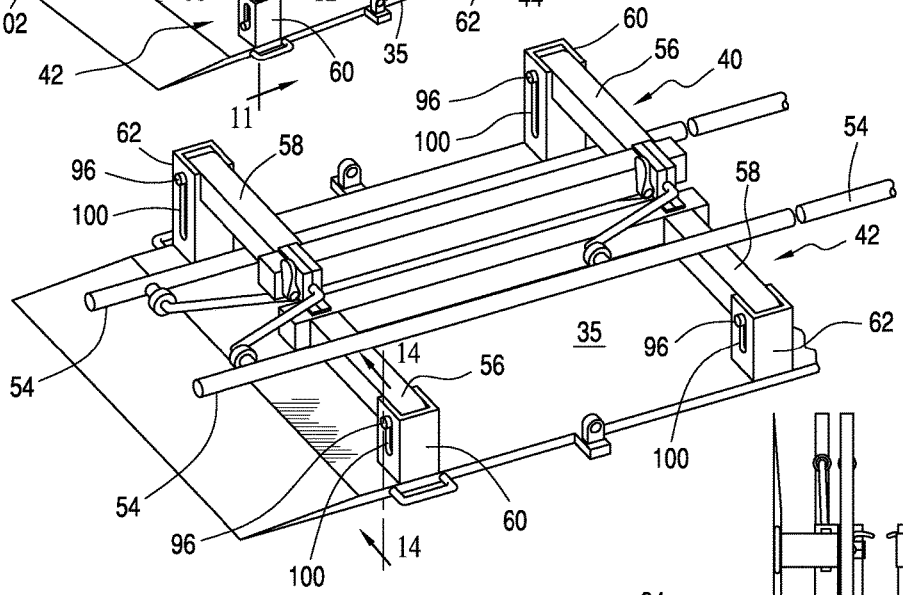
FIG. 6
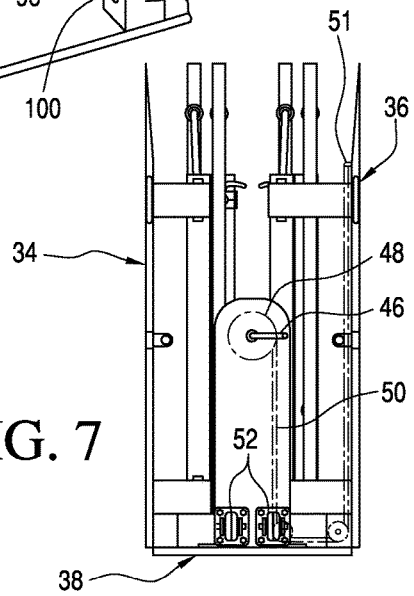
FIG. 7

FOLDABLE PARALLEL BAR APPARATUS

CROSS-REFERENCE TO RELATED APPLICATIONS

The present application claims priority on prior U.S. Provisional Applications Ser. No. 61/744,460, filed Sep. 27, 2012, and Ser. No. 61/851,743, filed Mar. 13, 2013, both of which are hereby incorporated herein in their entirety by reference.

FIELD AND BACKGROUND OF THE INVENTION

The present invention is generally directed to exercise apparatus, and more particularly to a foldable parallel bar apparatus for training, therapeutic, recreation, and other purposes.

The use of parallel bars in rehabilitative and physical therapy is vitally important in the healthcare profession. Parallel bars are used to provide patients with support while performing rehabilitative therapies to regain their strength, balance, range of motion, and independence. This rehabilitative therapy combines range of motion, muscle strengthening, and ambulatory exercises to counteract effects from being, for example, in a wheelchair for a sustained period of time or from prolonged bed rest and immobilization.

The overall market for rehabilitation and physical therapy products is one of fastest growing markets in the healthcare industry and is estimated at over $2 billion. The overall market has experienced significant growth over the last decade, which is expected to continue. In particular, equipment sales comprise two-thirds of the overall rehab and physical therapy market, and services represent the remaining third.

The conventional bar systems are either fixed to the ground, wall or even the ceiling, limiting the movement of the systems. In addition, current systems require dedicated space for the equipment.

Various examples of current systems are shown in U.S. Patents/Publication U.S. Pat. Nos. 3,929,330; 5,924,960, and US2004/0009845.

ASPECTS OF THE INVENTION

The present disclosure is directed to various aspects of the present invention.

One aspect of the present invention is to provide a parallel bar apparatus that is foldable or collapsible into a compact unit for storage or moving purposes.

Another aspect of the present invention is to provide a parallel bar apparatus that is modular in design and allows for an adjustable overall length without any obstruction or interruption in the path of a user.

Another aspect of the present invention is to provide a parallel bar apparatus that is stable in construction yet mobile and space-saving in structure without restrictions on the length of the parallel bars, thereby allowing multiple gait cycles along the length of the bars, and thus providing the clinicians, therapists, and other medical professionals with ample opportunity to observe the gait patterns of a patient or user.

Another aspect of the present invention is to provide a parallel bar apparatus in which the width between the parallel bars is adjustable to fit the needs of a user or patient. Specifically, the width is adjustable to at least a range of about 21" to 33".

Another aspect of the present invention is provide a parallel bar apparatus in which the height of the parallel bars is adjustable to fit the needs of a user or patient. Specifically, the height is adjustable to at least a range of about 27" to 44".

Another aspect of the present invention is to provide a parallel bar apparatus in which a single mechanism adjusts both the height of the parallel bars, as well as the width therebetween.

Another aspect of the present invention is to provide a parallel bar apparatus that includes a level walking surface to aid in rehabilitation.

Another aspect of the present invention is to provide a parallel bar apparatus that can accommodate users or patients weighing up to at least about 350 lbs.

Another aspect of the present invention is to provide a foldable parallel bar apparatus, which includes first and second end frames and a set of handrails connected to and extending between the first and second end frames, wherein the handrails are foldable so as to move the first and second end frames closer to one another thereby compacting the apparatus.

Another aspect of the present invention is to provide a foldable parallel bar apparatus, which includes a plurality of repeating modules connected to each other for extension or retraction. Each module includes first and second end frames, and a set of handrails connected to and extending between the first and second end frames, wherein the handrails are foldable so as to move the first and second end frames closer to one another thereby compacting the apparatus.

Another aspect of the present invention is to provide a parallel bar apparatus, which includes first and second handrails mounted on respective supports and an extension bar extending between at least one of the first and second handrails and the respective support, wherein the extension bar is rotatable relative to the respective support so as to move one of the first and second handrails vertically as well as horizontally.

Another aspect of the present invention is to provide a foldable parallel bar apparatus, which includes first and second sections that are foldable relative to each other and have a set of laterally spaced handrail units. Each handrail unit includes a handrail mounted on a support. An elbow bar is connected on one end to the handrail and includes another end received in the support. The elbow bar is rotatable relative to the support so as to move the corresponding handrail vertically, as well as horizontally.

BRIEF DESCRIPTION OF THE DRAWINGS

One of the above and other aspects, novel features and advantages of the present invention will become apparent from the following detailed description of the non-limiting preferred embodiment(s) of invention, illustrated in the accompanying drawings, wherein:

FIG. 5 is a perspective view of a second preferred embodiment of a foldable parallel bar apparatus in accordance with the present invention, shown in an unfolded position;

FIG. 6 illustrates one section of the apparatus of FIG. 5, showing the parallel bars being collapsed or folded down one atop the other;

FIG. 7 is a side elevational view of the apparatus of FIG. 5, shown in a folded position;

DETAILED DESCRIPTION OF THE PREFERRED EMBODIMENT(S) OF THE INVENTION

Referring to FIGS. 1-4, a first embodiment of the parallel bar apparatus PBA of the present invention will now be described. As shown, the parallel bar apparatus PBA includes repeating modules M that can provide a continuous, infinite length parallel bar apparatus. As described below in more detail, the design and construction of each module M and its inter-mechanical cooperation with adjacent modules, provides an uninterrupted path between the parallel bars for a user.

Figure 1:
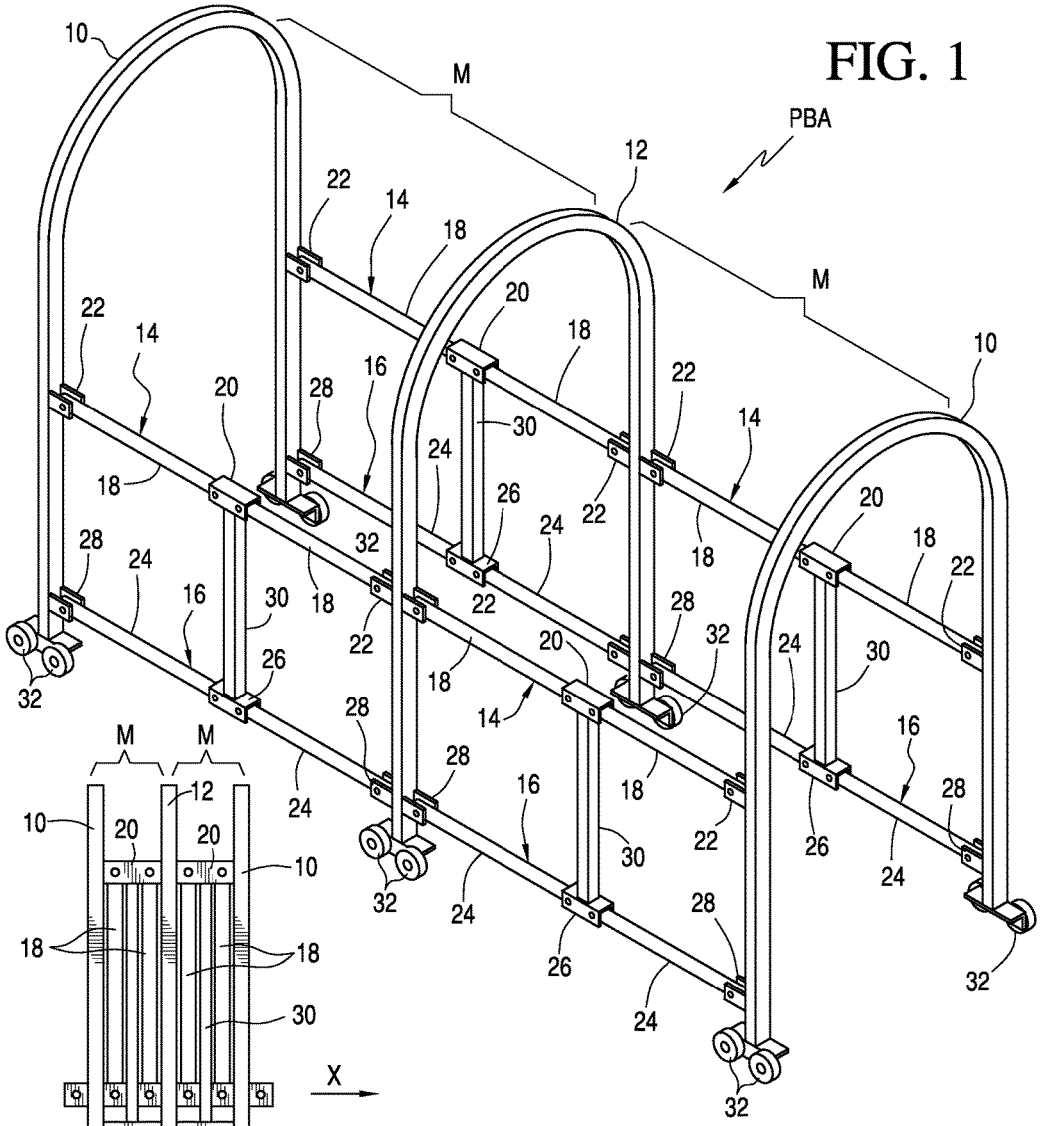
FIG. 1 is a perspective view of a first preferred embodiment of a foldable parallel bar apparatus in accordance to the present invention, shown in an unfolded position.
Figure 2:
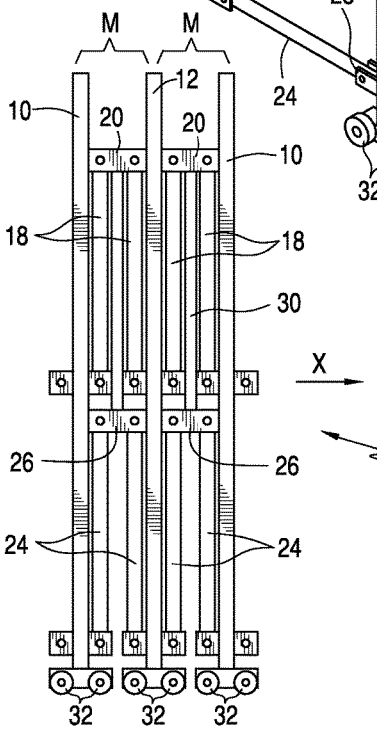
FIG. 2 is a side elevational view of the apparatus of FIG. 1, shown in a folded or collapsed position.

As best shown in FIGS. 1-2, each module M preferably includes arch or U-shaped end frames 10 and 12 connected by laterally spaced handrails 14. Another set of bars 16 runs closer to the ground and between the end frames 10 and 12, for enhanced stability of the modules M.

Figure 3:
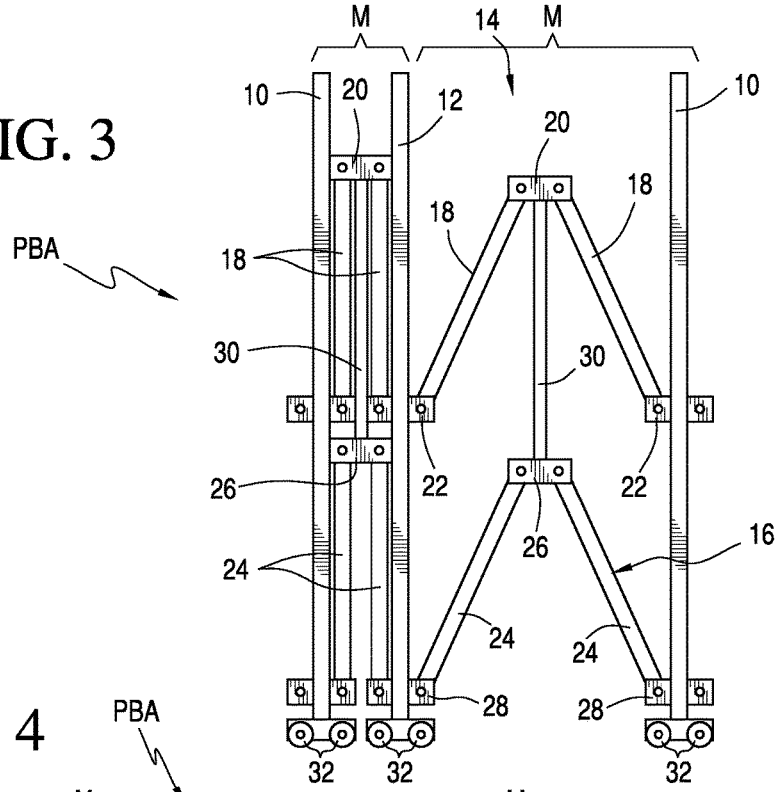
FIG. 3 is a view similar to FIG. 2, showing unfolding of a section or module of the apparatus.

Each handrail 14 is preferably made of two segments 18 that are pivotally connected to a sleeve 20 about a mid-point thereof. The segments 18 are further pivotally connected to the end frames 10 and 12 at joints 22. In the same manner, as best shown in FIG. 3, each bar 16 is preferably made of two segments 24 that are pivotally connected to a sleeve 26 at about a mid-point thereof. Likewise, the segments 24 are further pivotally connected to the end frames 10 and 12 at joints 28. Each handrail 14 and the corresponding bar 16 below it, are further vertically connected by a cross-bar 30 for structural rigidity. Suitable wheels or casters 32 are provided at the bottom of the end frames 10 and 12, in a known manner, to facilitate mobility of the parallel bar apparatus PBA.

Figure 4:
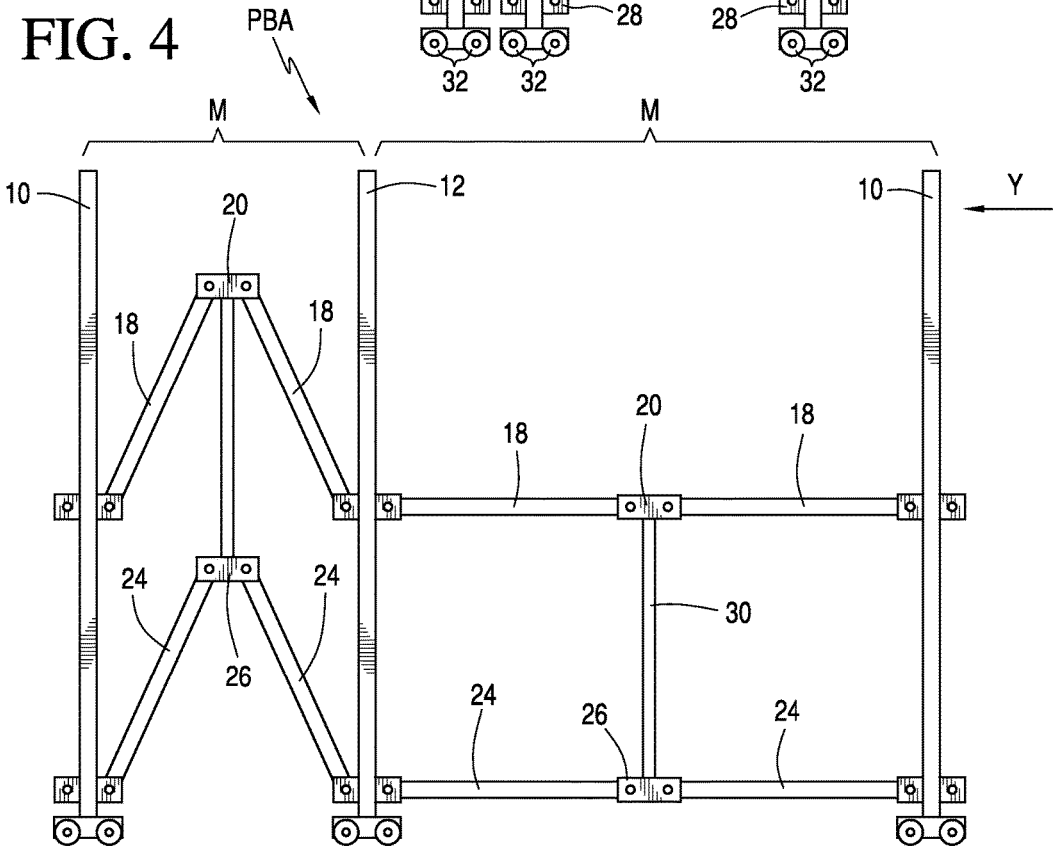
FIG. 4 is a view similar to FIG. 3, showing one section or module in a completely unfolded position and another section being unfolded.

From the above description, one would readily appreciate that by pulling on the rightmost end frame 10, in the direction shown by arrow X in FIG. 2, the right module M would open or unfold, as shown in FIG. 3. Once unfolded in this manner, and by further pulling in the same direction, the left module M would open or unfold, thereby extending the overall length of the parallel bar apparatus PBA (FIG. 4). In the same manner, one would further readily appreciate that by pushing back in the direction shown by arrow Y in FIG. 4, the modules M will fold or close one-by-one to reach the final compact position shown in FIG. 2.

Referring to FIGS. 5-14, a second preferred embodiment of the parallel bar apparatus PBAA will now be described. As best shown in FIG. 5, the parallel bar apparatus PBAA includes left and right sections 34 and 36, respectively, connected to each other by an intermediate section 38. The sections 34 and 36 are preferably identical and each includes a set of laterally spaced handrail units 40 and 42. Therefore, in a complete unit of the parallel bar apparatus PBAA, there will preferably be two generally opposed handrail units 40 and 42 in the left section 34, and two generally opposed handrail units 40 and 42 in the right section 36. Since the handrail units 40 and 42 of the left and right sections 34 and 36 are preferably identical to each other, only one is described below in more detail for clarity, and the same reference numerals are used for like components.

The left and right sections 34 and 36 are pivotally connected to the intermediate section 38 via hinges 44. As best shown in FIG. 7, a hand-crank mechanism 46 includes a pulley 48 and a cable 50 connected to the right section at 36. (A similar mechanism is provided for the left section 34 on the opposite side of the parallel bar apparatus PBAA.) One would readily appreciate that by actuating the hand-crank 46, the right section 36 and left section 34 can be easily folded or unfolded about the intermediate section 38. It is noted that suitable dampers or gas springs may be used to assist with the folding and unfolding. In order to provide mobility of the parallel bar apparatus PBAA, wheels or casters 52 are provided in the intermediate section 38 (FIG. 7).

Referring to FIG. 5, the handrail unit 42 will now be described. As shown, a handrail 54 is mounted on a support structure that includes laterally spaced support bars 56 and 58, which are slidably received in base posts 60 and 62, respectively. A cross-bar 64 extends horizontally between the support bars 56 and 58 for structural rigidity and support. The handrail 54 is pivotally connected to an elbow bar 66 at connection 68.

Figure 8:
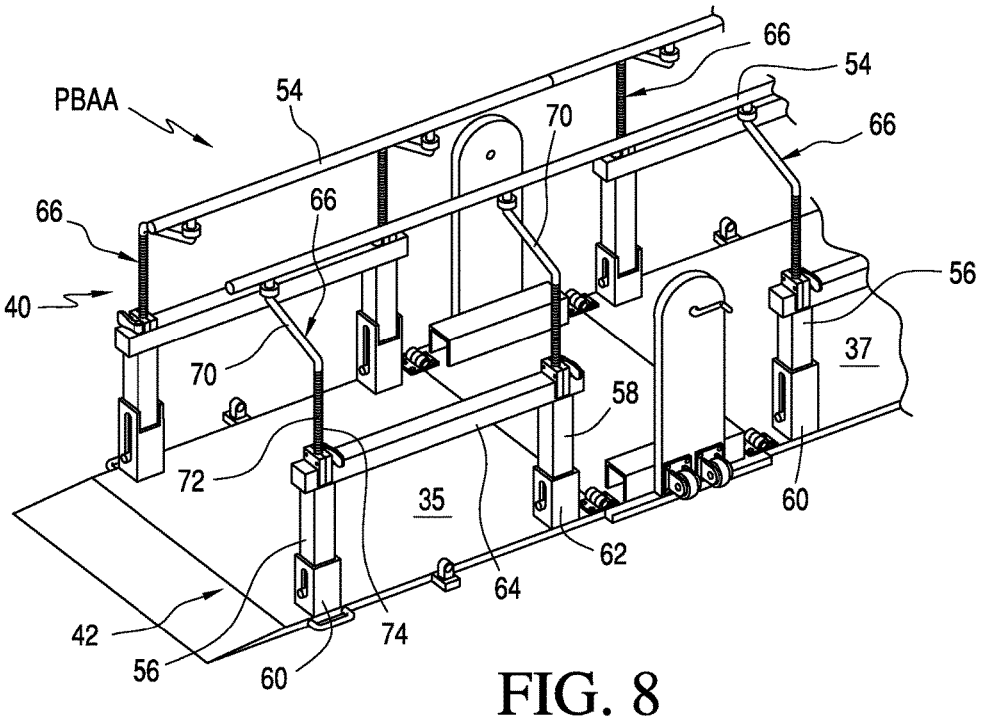
FIG. 8 is a partial view of the apparatus of FIG. 5, showing the parallel bars in a fully upwardly extended position.
Figure 9:
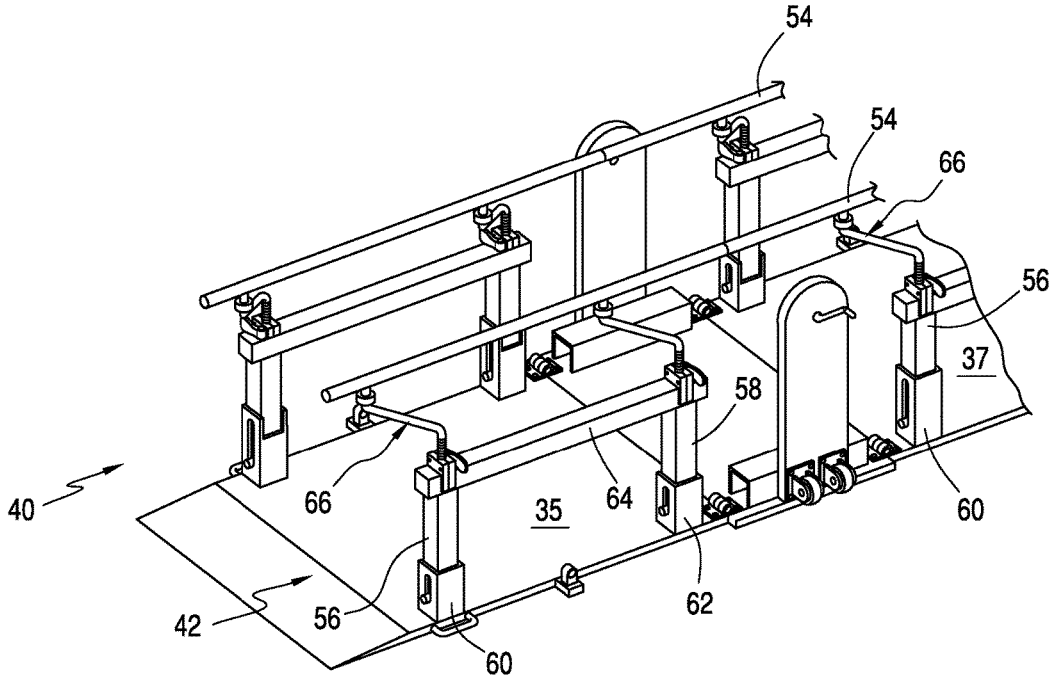
FIG. 9 is a view similar to FIG. 8, showing the parallel bars in a fully retracted position.
Figure 11:
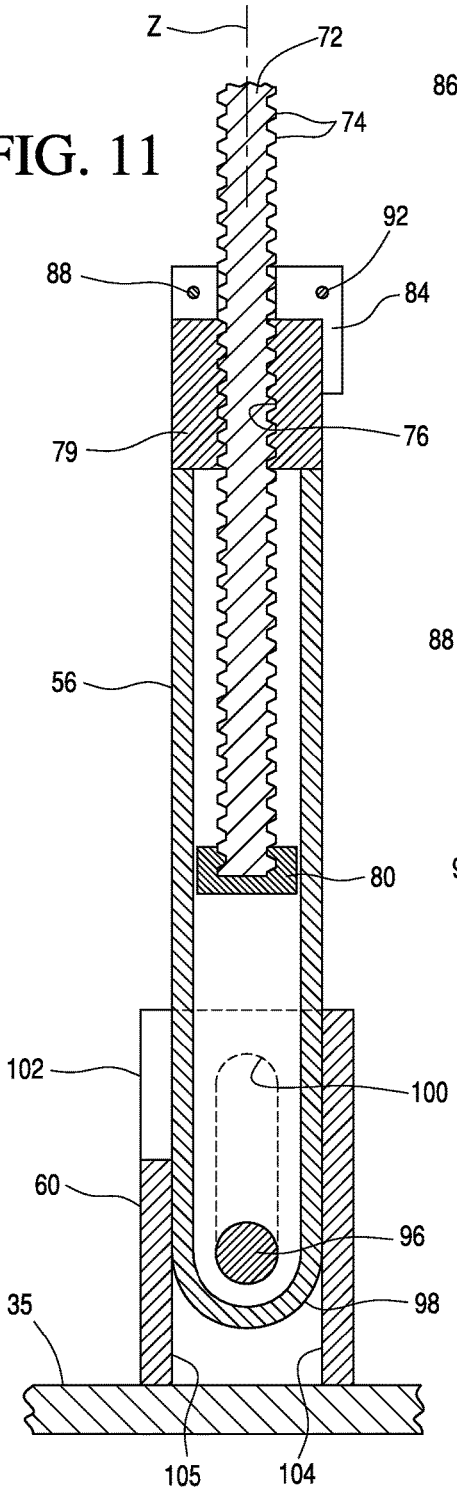
FIG. 11 is an enlarged sectional view taken along line 11-11 of FIG. 5.

As best in shown in FIG. 8, the elbow bar 66 includes an angled section 70, and a vertical section 72 rotatably received in the corresponding support bar 56 or 58. As best shown in FIG. 11, the vertical section 72 includes external screw-threads 74 that are in mechanical engagement with the internal screw-threads 76 of clamps 78 and 79 provided atop the support bar 56 (FIG. 5). One would appreciate that a rotation of the vertical section 72, relative to the clamps 78 and 79, would cause the handrail 54 to translate axially up and down, as well as rotate, about a longitudinal axis Z of the vertical section 72. Accordingly, by rotating the handrail 54 (and thus the vertical section 72) in one direction, the height of the handrail 54 relative to the base 35 can be raised (FIG. 8), or lowered by rotating in the opposite direction (FIG. 9). Although not shown, a suitable motorized mechanism may be used to rotate the handrails 54.

Figure 10:
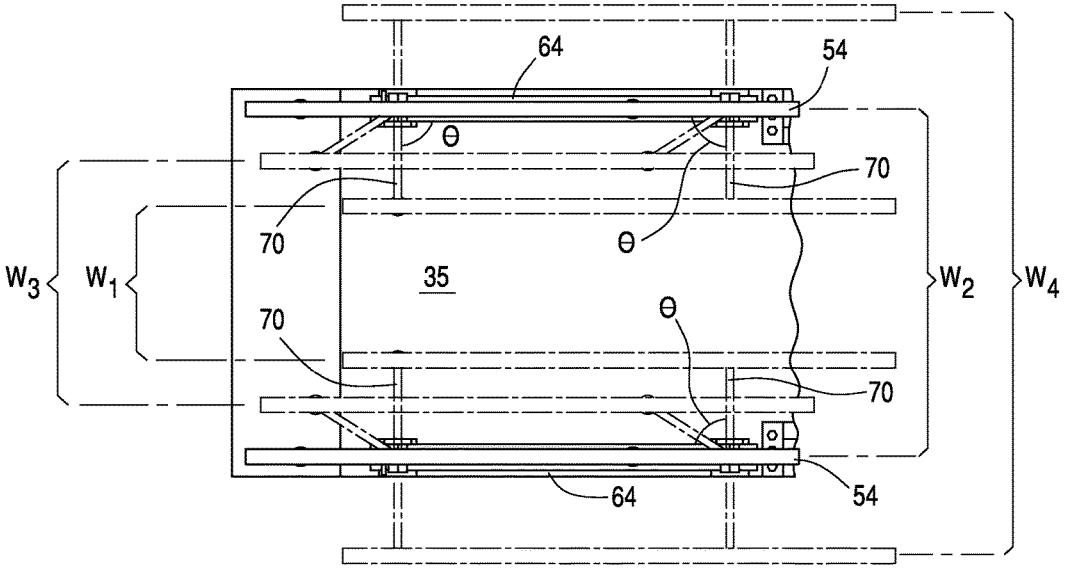
FIG. 10 is a partial top plan view of the apparatus shown in FIG. 9, showing adjustability of the width or distance between the parallel bars.

One would further appreciate that when the handrail 54 is rotated about the vertical section 72, the width between the two opposed handrails 54 would vary due to the positioning of the angled section 70. More particularly, as shown in FIG. 10, when the two opposed handrails 54 are rotated such that their corresponding angled sections 70 make a right angle ⊖ with the handrail 54, the width or distance between the handrails 54 would be the narrowest ($W_1$). On the other hand, when the handrails 54 are rotated to be positioned directly above the cross-bar 64, such that the angle between the angled sections 70 and the handrails 54 is 0 (zero), the width or distance between the handrails 54 would be wider ($W_2$). In the same manner, one would appreciate that when the angle ⊖ between the handrails 54 and their corresponding angle sections 70, is between 0° and 90°, an intermediate width between the handrails would be obtained ($W_3$). In this regard, it is noted that the widest distance ($W_4$) between the handrails 54 would be obtained by a rotation thereof to a farthest position outside the base 35, where the angle ⊖ is 180° relative to the narrowest width $W_1$. As shown in FIG. 11, a suitable stop 80 is provided at the bottom end of the vertical section 72 to prevent complete withdrawal thereof from the support bar 56.

Figure 12:
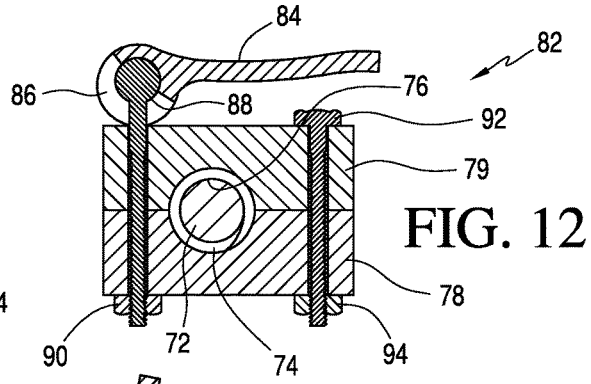
FIG. 12 is an enlarged sectional view taken along line 12-12 of FIG. 5, showing the clamp in a locked position.

In order to immobilize or lock the vertical section 72 at a desired vertical position relative to the support bar 56, a locking mechanism 82 (FIGS. 12-13) is provided. In particular, as noted above, the screw threads 76 of the clamps 78 and 79 are in engagement with the screw-threads 74 of the vertical section 72 (FIG. 12). A tension lever 84 includes a cam portion 86 that engages the clamp 79 via an eccentric pin 88, which also holds together one side of the clamps 78 and 79 with a nut 90. The other side of the clamps 78 and 79 is held together by a fastener 92 and a nut 94. In a closed or tension position shown in FIG. 12, the cam portion 86 exerts a force on the clamp 79, and thus against the vertical section 72. In this position, the external screw-threads 74 of the vertical section 72 are in tight frictional engagement with the screw-threads 76 of the clamps 78 and 79. As a result, the vertical section 72 is in a locked position.

Figure 13:
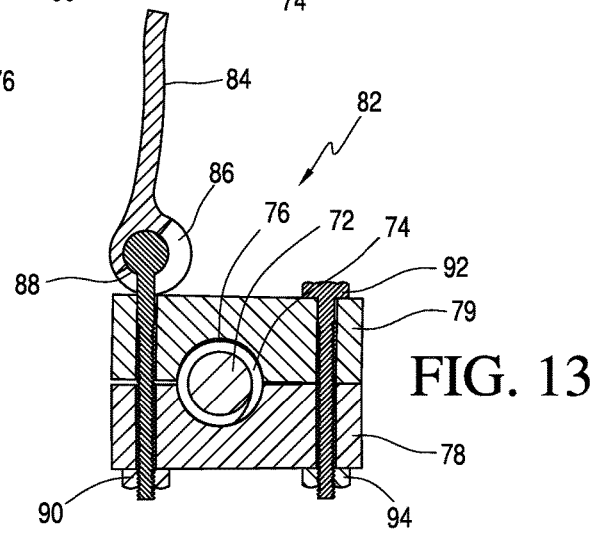
FIG. 13 is a view similar to FIG. 12, showing the clamp in an unlocked position.

On the other hand, as shown in FIG. 13, when the tension lever 84 is rotated to be in an open position, the cam portion 86 no longer frictionally engages the clamp 79, thereby allowing the clamps 78 and 79 to separate slightly. In this position, the external screw-threads 74 of the vertical section 72 are no longer in tight frictional engagement with the screw-threads 76 of the clamps 78 and 79. The vertical section 72 is, therefore, free to rotate relative to the clamps 78 and 79.

Figure 14:
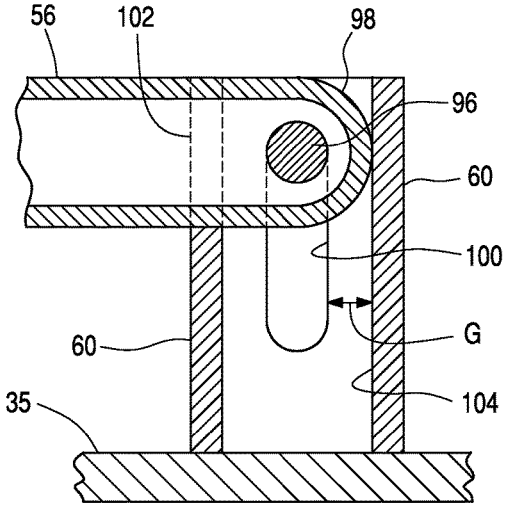
FIG. 14 is an enlarged sectional view taken along line 14-14 of FIG. 6.

Referring to FIGS. 6, 11 and 14, the folding mechanism of the parallel bar apparatus PBAA will now be described. As shown, a pin 96 is fixedly mounted adjacent the rounded bottom end portion 98 of the support bar 56. The pin 96 is free to travel in an oblong slot 100 provided on one side of the corresponding post 60. A cut-out 102 provided on the side of the post 60 facing the base 35 (FIG. 5), allows the support bar 56 to pivot inwardly for folding purposes.

In particular, when it is desired to fold the handrail units 40 and 42, the entire unit 42, for example, is first lifted upwardly until the pin 96 reaches the top end of the slot 100 (FIG. 14) and then pivoted or rotated inwardly toward the cut-out 102. In this regard, one would readily appreciate that the length of the rounded bottom end portion 98 of the support bar 56, is selected so as to clear the gap G between the slot 100 and the inside wall 104 of the post 60. This allows the support bar 56 to pivot inwardly into the cut-out 102, as just described. Once the handrail unit 42 has been folded down inwardly toward the base 35, the handrail unit 40 can then be folded down inwardly on top of the previously folded unit 42 (FIG. 6).

When it is desired to unfold or set up the parallel bar apparatus PBAA, the handrail unit 40, for example, which is resting on top of the previously folded unit 42, for example, is simply pivoted outwardly away from the base 35, until the support bars 56 are fully erect in the corresponding base posts 60 and 62. The handrail section 40 is then simply allowed to slide downwardly (by gravity) until the pins 96 reach the bottom most part of the slots 100 (FIG. 11). In this position, the rounded end portion 98 of the support bar 56 is disposed well below the cut-out 102 and is secure in between the opposed side walls 104 and 105 of the post 60. The other handrail unit 42 may then be erected in the same manner.

While this invention has been described as having preferred sequences, ranges, steps, order of steps, materials, structures, symbols, indicia, graphics, color scheme(s), shapes, configurations, features, components, or designs, it is understood that it is capable of further modifications, uses and/or adaptations of the invention following in general the principle of the invention, and including such departures from the present disclosure as those come within the known or customary practice in the art to which the invention pertains, and as may be applied to the central features hereinbefore set forth, and fall within the scope of the invention and of the limits of the claims appended hereto or presented later. The invention, therefore, is not limited to the preferred embodiment(s) shown/described herein.

What is claimed is:

1. A parallel bar apparatus, comprising:

a) first and second handrails, said first handrail mounted on first and second supports;

b) a first elbow bar extending between said first handrail and said first support and a second elbow bar extending between said first handrail and said second support, each said elbow bar comprising a first vertical section and a second vertical section connected to one another by an angled section, said first vertical sections of said elbow bars being attached to said first handrail, said second vertical section of said first elbow bar being attached to said first support, said second vertical section of said second elbow bar being attached to said second support.

2. The apparatus of claim 1, wherein:

each said support includes a respective base post and a support bar pivotable relative thereto.

3. The apparatus of claim 1, wherein:

a) each said second vertical section comprises a respective screw-threaded portion; and b) each said first and second support comprises a respective screw-threaded portion, said screw-threaded portion of said first support cooperating with said second vertical section of said first elbow bar, said screw-threaded portion of said second support cooperating with said second vertical section of said second elbow bar.

4. The apparatus of claim 3, wherein:

each said first vertical section of said first and second elbow bars are pivotably connected to said first handrail.

5. The apparatus of claim 4, further comprising:

a clamping means mounted on said first support for locking said second vertical section of said first elbow bar relative to said first support.

6. The apparatus of claim 1, wherein:

said second handrail is mounted on third and fourth supports;

a third elbow bar extends between said second handrail and said third support and a second elbow bar extends between said second handrail and said fourth support, each said third and fourth elbow bar comprising a first vertical section and a second vertical section connected to one another by an angled section, said first vertical sections of said third and fourth elbow bars being attached to said second handrail, said second vertical section of said third elbow bar being attached to said third support, said second vertical section of said fourth elbow bar being attached to said fourth support.

7. The apparatus of claim 6, wherein:

each said third and fourth support includes a respective base post and a support bar pivotable relative thereto.

8. The apparatus of claim 6, wherein:

each said second vertical section of said third and fourth elbow bars comprises a respective screw-threaded portion; and each said third and fourth support comprises a respective screw-threaded portion, said screw-threaded portion of said third support cooperating with said second vertical section of said third elbow bar, said screw-threaded portion of said fourth support cooperating with said second vertical section of said fourth elbow bar.

9. The apparatus of claim 8, wherein:

each said first vertical section of said third and fourth elbow bars are pivotably connected to said second handrail.

10. The apparatus of claim 9, further comprising:

a clamping means mounted on said third support for locking said second vertical section of said third elbow bar relative to said third support.

11. A foldable parallel bar apparatus, comprising:

a) first and second sections foldable relative to each other;

b) each of said first and second sections including a first and a second handrail laterally spaced from one another;

c) said first handrail being mounted on a first and second support by respective first and second elbow bars, said second handrail being mounted on third and fourth supports by third and fourth elbow bars;

d) each said elbow bar comprising a first vertical section and a second vertical section connected to one another by an angled section, said first vertical sections of said first and second elbow bars being connected to said first handrail, said first vertical sections of said third and fourth elbow bars being connected to said second handrail, said second vertical section of said first elbow bar being connected to said first support, said second vertical section of said second elbow bar being connected to said second support, said second vertical section of said third elbow bar being connected to said third support, said second vertical section of said fourth elbow bar being connected to said fourth support; and e) said elbow bars being rotatable relative to said supports so as to move said first and second handrails vertically as well as horizontally.

12. The apparatus of claim 11, wherein:

a) each of said first and second sections includes a platform;

b) each of said supports respectively comprises a base post mounted on the platform and a support bar pivotable relative to said base post.

13. The apparatus of claim 12, wherein:

a) each said second vertical section of each said elbow bar comprises screw-threads;

b) each said support bar includes a sleeve with an internal screw-threaded portion; and c) each said second vertical section is in screw-threaded engagement with a respective one of said sleeves.

14. The apparatus of claim 13, wherein:

a) each said elbow bar is rotatable relative to said handrail and forms an angle therebetween.

15. The apparatus of claim 14, wherein:

a) the angle varies from 0° to at least 90°.

16. The apparatus of claim 15, wherein:

a) an angle of 90° formed between said elbow bars and said first and second handrails provides a narrowest width between the handrails.

17. The apparatus of claim 16, wherein:

a) an angle of 0° formed between said elbow bars and said first and second handrails provides a width wider than the narrowest width between the handrails.

18. The apparatus of claim 15, wherein:

a) an angle between 0° to 90° formed between said elbow bars and said first and second handrails provides an intermediate width between the handrails.

19. The apparatus of claim 13, further comprising:

first and second clamping means mounted respectively on said first and third supports for locking said first and third elbow bars relative to said sleeve.

20. The apparatus of claim 12, wherein:

a) each said base post and said support bar are in operable engagement by a pin and slot arrangement thereby allowing said handrails to fold down toward the platform.

21. The apparatus of claim 11, further comprising:

a) wheels or casters mounted on at least one of said sections for moving the apparatus.

22. The apparatus of claim 11, further comprising:

a) a third said section positioned between said first and second sections.

23. The apparatus of claim 22, wherein:

a) said first section is foldably connected to said third section on one side thereof and said second section is foldably connected to said third section on the opposite side thereof.

24. The apparatus of claim 23, further comprising:

a) means for folding or unfolding said first and second sections substantially simultaneously comprising a manually-operated crank mechanism.

25. The apparatus of claim 24, further comprising:

a) wheels or casters mounted on at least one of said sections for moving the apparatus.

26. The parallel bar apparatus according to claim 11, wherein:

said supports are mounted on a generally flat base member.

* * * * *